US006209370B1

(12) United States Patent
Larson et al.

(10) Patent No.: US 6,209,370 B1
(45) Date of Patent: Apr. 3, 2001

(54) NON DAMAGING KEY LOCK

(75) Inventors: Erik S. Larson, Norwood, MA (US); Richard L. Nie, Columbus, OH (US)

(73) Assignee: Engineered Plastics Solutions Group, Inc., Norwood, MA (US)

( * ) Notice: Subject to any disclaimer, the term of this patent is extended or adjusted under 35 U.S.C. 154(b) by 0 days.

(21) Appl. No.: 09/323,923

(22) Filed: Jun. 2, 1999

(51) Int. Cl.[7] ..... E05B 11/00
(52) U.S. Cl. ..... 70/389; 70/19; 70/456 R
(58) Field of Search ..... 70/389, 19, 456 R

(56) References Cited

U.S. PATENT DOCUMENTS

| | | | | |
|---|---|---|---|---|
| 1,016,541 | * | 2/1912 | Boone et al. | 70/389 |
| 3,535,898 | * | 10/1970 | Allport | 70/389 X |
| 3,575,024 | * | 4/1971 | Schlage | 70/389 |
| 3,636,742 | | 1/1972 | Raney . | |
| 3,708,032 | * | 1/1973 | Suzuki | 70/389 X |
| 4,083,210 | * | 4/1978 | Bergin | 70/389 X |
| 4,090,380 | | 5/1978 | Bianco . | |
| 4,160,369 | | 7/1979 | Pearson . | |
| 4,441,348 | | 4/1984 | Neilson . | |
| 4,448,051 | | 5/1984 | Neilson . | |
| 4,570,469 | | 2/1986 | Neilson . | |
| 4,641,509 | * | 2/1987 | Batchelor et al. | 70/389 X |
| 4,662,199 | | 5/1987 | Neilson . | |
| 5,051,724 | | 9/1991 | Morrow . | |
| 5,209,090 | | 5/1993 | Stillwagon . | |
| 5,505,066 | | 4/1996 | Baucom . | |
| 5,713,224 | * | 2/1998 | Liou | 70/389 X |
| 5,878,613 | * | 3/1999 | Tabacchi et al. | 70/389 |

FOREIGN PATENT DOCUMENTS

| | | | | |
|---|---|---|---|---|
| 2213342 | * | 9/1973 | (DE) | 70/389 |
| 2855019 | * | 7/1980 | (DE) | 70/389 |
| 2539448 | * | 7/1984 | (FR) | 70/389 |

* cited by examiner

*Primary Examiner*—Suzanne Dino Barrett
(74) *Attorney, Agent, or Firm*—Thomas E. Hagar

(57) ABSTRACT

A key retaining device that secures the functional section of the key while leaving the non functional section exposed for easy identification. The device is able to lock individual keys on a large key chain without interference with the non locked keys. The key can only be removed with the use of a master key. The device's simple and inexpensive design includes only five components: namely a housing to enclose the key, two deformable substrates, a unique set screw, and a master key. There is a bore inside the housing that runs longitudinally within the housing. The bore has a threaded section that contains the screw and a non-threaded section that contains the two deformable substrates. There is a blind slot at the base of the housing which runs from one side of the housing to the non-threaded section of the bore. The functional section of the key is placed through the blind slot, into the non-threaded section of bore, and between the two deformable substrates. The master key then turns down the screw which clamps the deformable substrates around the functional section of the key. The unique design of the substrates will not damage the key upon clamping but will immobilize the key to prevent removal. The key is simply removed by turning back the screw using the master key and pulling key out of the blind slot.

2 Claims, 4 Drawing Sheets

NON DAMAGING KEY LOCK

BACKGROUND a) Field of the Invention

This invention relates to the industry of key-locking devices. There are several types of key-locking devices. The designs range from completely enclosing the key to a clamping device which locks the working part of the key. Most of the latter devices use a mechanical clamping method.

b) Description of the Related Art

There has always has been and will always be a need in the market for a key securing system to prevent access by unauthorized personnel, but which is user friendly. This is true whether it is a house key for real estate brokers to show homes for rent or sale, or whether it is your local parking garage. The need is especially crucial with valet style parking garages which typically retain the customer's keys after parking the car. Parking garages that retain the customer's keys have a great administrative burden. A choice between retaining the key in a central secure location or leaving the keys in the car. The former is a logistical burden to the attendant due to the time required to drop the key off after parking the car and that required to pick it up prior to retrieving the car. Also, the keys need to be tagged and organized in the secure location. This unfortunately leads to keys being misplaced or mis-tagged. The alternative of leaving the keys in the car is not much better in that more attendants are required to police the garage to prevent unauthorized personnel from stealing the car. Either way the options are not desirable since they are either a logistical nightmare or an unnecessary increase in overhead costs, or both.

The present invention solves this dilemma. The invention is a portable key locking device which can be kept in the car, thereby eliminating the logistical nightmare of a central locking area. It secures the key from use by unauthorized personnel, thereby eliminating the need for unnecessary overhead required to police the entire garage.

Prior designs have either totally encapsulated the key or left part of the key exposed while using a hard steel locking mechanism.

The encapsulating designs have several disadvantages. One disadvantage is the fact that since the key is fully hidden from view it is not readily apparent which key is in the lock. Secondly, if the lock is destroyed, the key remains intact. The problem here is breaking the lock leaves a perfectly functional key thus rendering the security aspect of the design moot. These shortcomings are overcome by the present invention, which leaves the head of the key exposed thereby allowing easy identification of its contents. Secondly, it is designed to break the key if same is removed by force. Accordingly, the key is rendered useless to unauthorized personnel.

The designs which leave the key exposed use a metal clamping mechanism which holds the key in place. The Bianco design (U.S. Pat. No. 4,090,380) uses metal 'vice jaws' which clamp the key in place. Unfortunately, these jaws damage the key rendering the key inoperative in the ignition. This damage occurs even though the lock was solely used by authorized personnel. Other designs use several moving parts to clamp the key which increase the cost of the device. Furthermore, the more moving parts that exist increase the chance that something will fail in the device.

The present invention resolves these shortcomings among the exposed key devices, since it uses revolutionary non-damaging substrates to clamp the key thereby eliminating the damage to the key. It has few moving parts which decreases the likelihood of the device failing and decreases its overall cost.

In summary, the present invention is a simply designed portable key securing system which does not damage the key when used by authorized personnel. It provides a simple solution to the market areas which require the flexibility obtained from a portable key securing system.

For the foregoing reasons stated above, there is a need for an inexpensive, reliable, non-damaging key locking device that is portable to provide flexibility for the person using the device.

SUMMARY OF THE INVENTION

The present invention is directed to an apparatus that satisfies the need of securing a key with the flexibility of a portable device that is inexpensive and will not damage the key during authorized operation. The device is comprised of fives components namely: a housing to enclose the key, two deformable substrates, an unique locking screw, and a master key. There is a bore inside the housing that runs longitudinally within the housing. The bore has a threaded section that contains the locking screw and a non-threaded section that contains the two deformable substrates. There is a blind slot at the base of the housing which runs perpendicular to the bore from one side of the housing through the non-threaded section of the bore. The functional section of the key is placed through the blind slot, into the non-threaded section of the bore, and between the two deformable substrates. The master key then turns down the screw which clamps the deformable substrates around the functional section of the key. The unique design of the substrates will not damage the key upon clamping but will immobilize the key to prevent removal. The key is simply removed by turning back the screw using the master key and pulling the key out of the blind slot.

Accordingly, one object of the invention is to provide a securing system that can immobilize a key to prevent unauthorized use.

Another object of the invention is that it only secures the working section of the key thereby leaving the non functioning section exposed for easy identification.

A third object of the invention is to provide a portable securing system which provides flexibility to markets such as real estate brokers and parking garages whom need the portability to save overhead costs and logistical problems.

A fourth object of the invention is to provide a unique securing device that does not damage the object being secured during the operation of the invention.

A fifth object of the invention is that once secured, the object can not be removed by unauthorized personnel without rendering the key inoperable thereby increasing the security of the invention.

A sixth object of the invention is that it is inexpensive to manufacture, rugged in design, durable, easy to operate, and contains few moving parts thereby decreasing the likelihood of failure.

A seventh object of the invention is the blind slot in the housing which prevents access from one side thus increasing the security and immobilization of the object.

An eighth object of the invention is that the deformable substrates can be easily removed, interchanged, inverted, and/or replaced thereby extending the life of the product.

A ninth object of the invention is a specially designed protrusion on the locking screw that can not be defeated with commercially available tools.

A tenth object of the invention is that enough of the key is exposed so that the clamping mechanism does not touch the area of the key where computer chips are presently embedded.

Other objects and advantages of the invention will be apparent from the following detailed description taken in conjunction with the accompanying drawings.

BRIEF DESCRIPTION OF THE DRAWINGS

These and other features, aspects and advantages of the present invention will become better understood with reference to the following description, appended claims, and accompanying drawings where.

DETAILED DESCRIPTION OF THE PREFERRED EMBODIMENT

Figure 1:
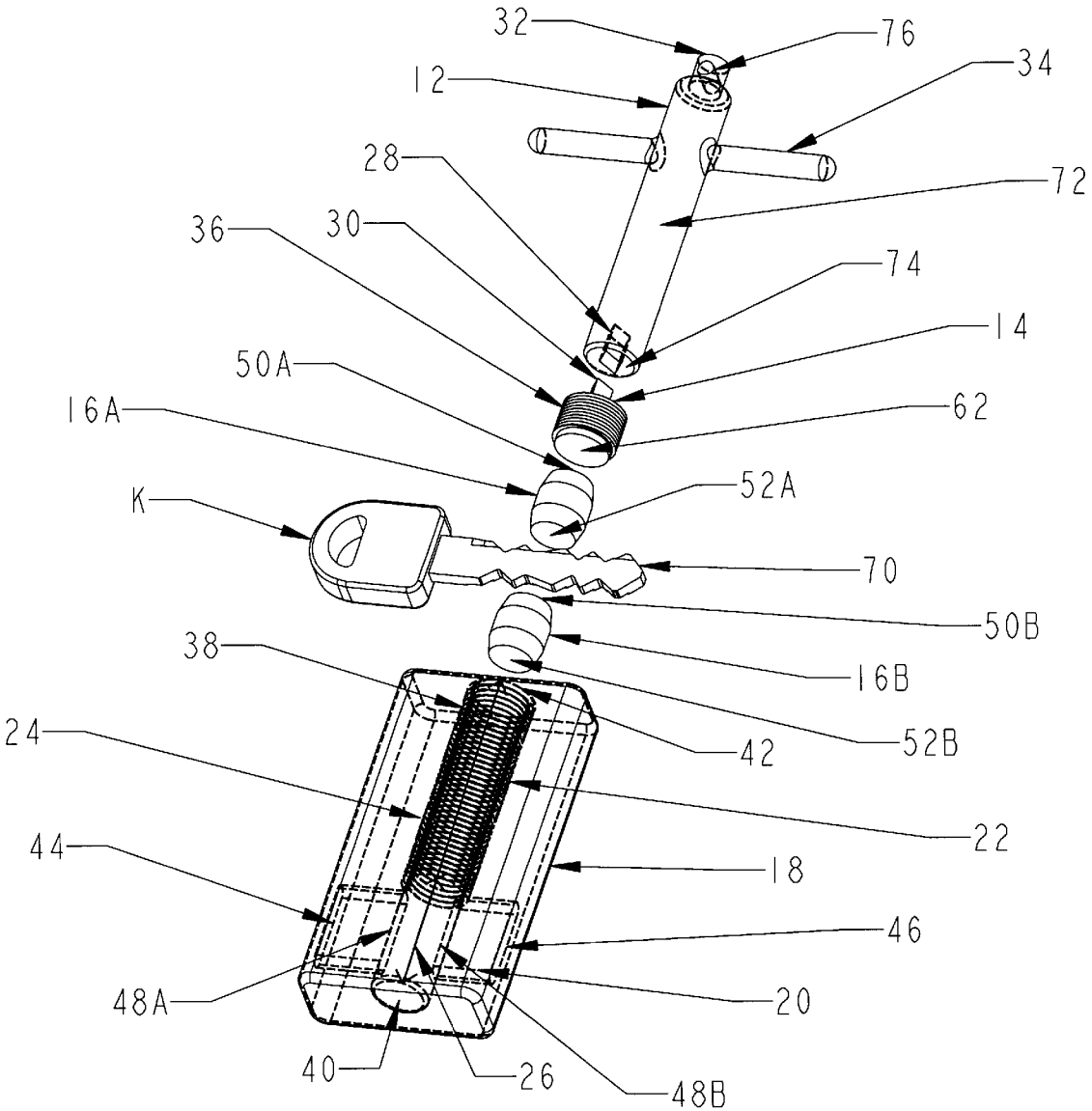
FIG. 1 is an exploded perspective view of the preferred embodiment showing the parts of the invention.

Referring to the Figures, and more specifically FIG. 1, the invention 10 consists of a rectangular shaped housing 18 with a cylindrically shaped bore 22 which is centered in the housing 18 and runs along the longitudinal axis of the housing 18. At the base of the housing 18 is a blind slot 20 which is centered in the height of the housing 18 and runs nearly the entire width of said housing. The housing 18 is made out of light and strong material with the preferred material being aluminum. The preferred dimensions of the housing 18 are 2.960 in.×1.500 in.×0.6300 in.

The bore 22 has a threaded section 24 and a non-threaded section 26. The threaded section 24 accepts the locking screw 14 via the engagement of the threads 36 of the locking screw 14 with the threads 38 of the threaded portion of the bore 24. The tee handle wrench 12 is used to engage the locking screw 14 with the bore 22. The bore 22 has an open end 42 and a closed end 40. The open end 42 allows the assembly and operation of the invention 10 while the closed end 40 acts as a positive stop for the deformable substrates 16*a* and 16*b*. The preferred embodiment has the bore 22 diameter being 15⁄32th of an inch. The bore 22 is manufactured using general machining practices of drilling the hole and then threading the same with a tap.

The locking screw 14 is cylindrically shaped with a threaded section 36 on the cylindrical surface. During operation of the invention, the locking screw 14 is contained in and moves axially within the bore 22. Said screw has a base surface 62 which interfaces with the top surface 50*a* of the deformable substrate 16*a*. The preferred embodiment has both surfaces 50*a* and 62 flat and smooth thereby decreasing friction for smooth operation. On the top of said screw is a geometrically shaped protrusion 30 which engages the corresponding geometrically shaped cavity 28 of the tee handle wrench 12. There are several geometrically designs for the protrusion 30 and the cavity 28. For every male geometrically designed protrusion 30 there is a matching female geometrically design cavity 28. In order to operate the invention 10, one must use the tee handle wrench 12 that has the cavity 28 that matches the protrusion 30. Otherwise the invention 10 can not be operated thereby increasing the security.

The tee handle wrench 12 is cylindrically shaped and consists of a main section 72 and a handle 34. At the base of the main section 72 is a flat surface 74 and at the top is a holding knob 32. At the center of the base surface 74 is the notch 28. The holding knob 32 has a hole 76 drilled through its center axis to allow the tee handle wrench 12 to be carried on any conventional key chain in conjunction with other keys or other tee handle wrenches. The handle 34 is near the top of, runs through the center axis of and is perpendicular to the main section 72. The diameter of the main section 72 is less than the diameter of the bore 22 thereby allowing the tee handle wrench 12 to enter the bore 22 and operate the invention 10. The preferred embodiment has a difference of 0.060 inches (0.030 inches per side) between the two said diameters.

The slot 20 has an open end 44 and a closed end 46. The open end 44 allows a means for the introduction working section 70 of the key K into the housing 18 (See FIG. 5). The closed end 46 of the slot 20 acts as a positive stop for the key K so that the key K will not extend through the housing 18 thereby increasing its security. The slot 20 runs nearly the entire width of the housing 18 and is located below the bottom of the thread section 24 of the bore 22. The width of the slot 20 is in the center of the depth of the housing 18 while the length of the slot 20 runs perpendicular with the bore 22. The width of the slot 20 in the preferred embodiment is 1.650 inches.

The slot 20 runs through and is transverse to the longitudinal axis of the bore 22. As a result, the key K is introduced transverse to the longitudinal axis of the bore 22. The slot 20 and the bore 22 interface at the areas 48*a* and 48*b*. The slot 20 only interfaces with the non-threaded section 26 of the bore 22.

The deformable substrates 16*a* and 16*b* are identically designed. The substrates move axially and freely within the bore 22. In FIG. 8, it is shown that said substrates have a general cylindrical barrel shape design with a side section 58, bevel sections 60, a top surface 50 and a bottom surface 52. Said substrates are symmetrical along their center axis enabling the substrates to be interchanged and/or inverted for longer life. The diameter of the substrates is less than the diameter of the bore 22 in order that the substrates may be placed in the bore 22 for operation. The preferred embodiment has the difference in diameters being 0.075 inches (0.0375 inches per side) for easy assembly and operation while maintaining maximum clamping ability. The side section 58 of the substrates rest against the side wall 64 of the bore 22 (See FIG. 7). The bevel section 60 is designed to compensate for horizontal compression during clamping and as an aid to facilitate the introduction of the key K between the two deformable substrates 16*a* and 16*b*. The preferred angle for the bevel 60 is fourteen (14) degrees. The deformable substrates 16*a* and 16*b* are made from a deformable material with the preferred embodiment having the substrates made of acetal copolymer. Said substrates may be molded using conventional molding techniques.

During operation the deformable substrates 16*a* and 16*b* will be slightly compressed and lose some of their height.

The invention 10 is simply assembled by placing the deformable substrates 16*a* and 16*b* into the bore 22. Gravity allows both deformable substrates 16*a* and 16*b* to rest on the closed end 40 of the bore 22. Next, the protrusion 30 of the locking screw 14 is then placed into the corresponding cavity 28 of the tee handle wrench 12. Using the tee handle wrench 12, the threads 36 of the locking screw 14 are engaged with the threads 38 of the thread section 24 of the bore 22. The locking screw 14 is then turned down about half way down the threaded section 24 of the bore 22. The invention 10 is now in its starting position (See FIG. 2.0 and FIG. 3).

Figure 4:
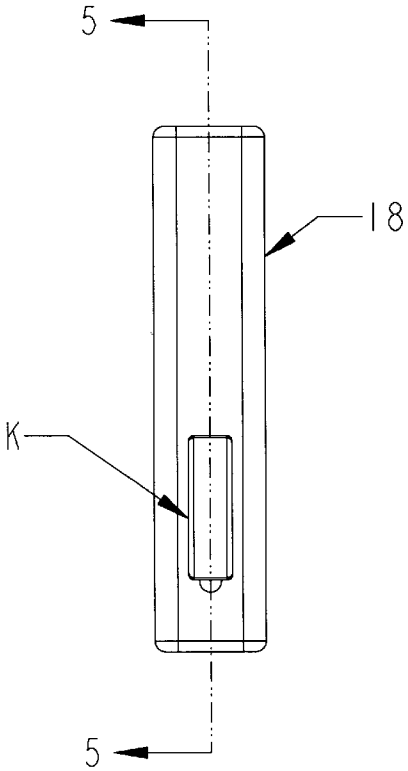
FIG. 4 is side elevation of the preferred embodiment of the invention prior to clamping.

The invention 10 is operated by simply placing the working section 70 of the key K into the slot 20. The key K itself will cause the two deformable substrates 16*a* and 16*b* to separate thereby positioning the key K between said substrates. The key K is then pushed until it hits the closed end 46 of the slot 20 (See FIG. 4 and FIG. 5). Using the appropriate tee handle wrench 12, which geometrical cavity 28 matches the geometrical protrusion 30 on the locking screw 14, the tee handle wrench 12 is placed into the bore 22 and over the locking screw 14. Next, said wrench is then turned down to move the said locking screw axially toward the top deformable substrate 16*a*. Said wrench is turned down until it is finger tight. The tee handle wrench 12 is then turned down enough (usually one half turn) to immobilized the key and then removed. This action causes the two deformable substrates 16*a* and 16*b* to clamp around the key K (See FIG. 6 and FIG. 7). The clamping means is created by the axial movement of the locking screw 14, via the threads in the bore 22, towards the closed end 40 of the bore 22. As a result, the substrates 16*a* and 16*b* are forced against the closed end 40 of the bore 22 causing the substrates to clamp around the key K. As this force is increased by the turning of the tee handle wrench 12, the deformable substrates 16*a* and 16*b* deform and clamp around the working section 70 of the key K thereby immobilizing it. The revolutionary unique ability of the substrates 16*a* and 16*b* to deform allows them to deform around and lock the key K while at the same time not damage the same.

The key K is simply removed by inserting into the bore 22 the tee handle wrench 12 with the appropriate cavity 28 and turning axially upward the locking screw 14 to the starting position. The key K is then wiggled, which releases the deformable substrates 16*a* and 16*b*, and removed.

Figure 3:
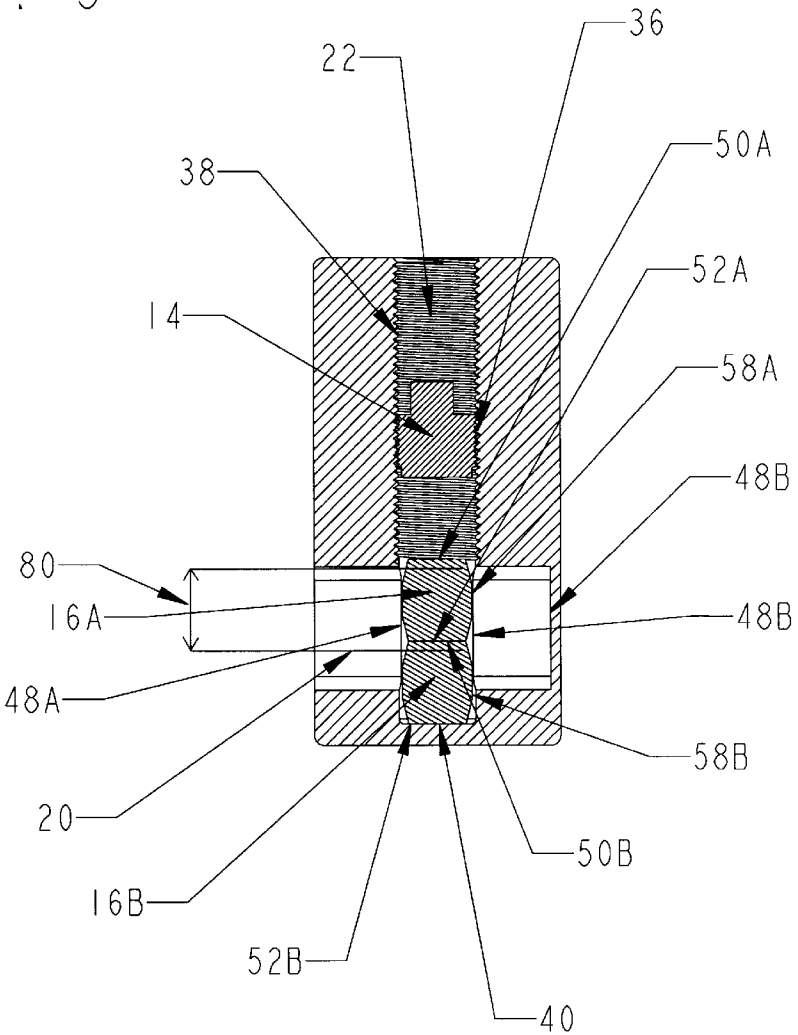
FIG. 3 is a longitudinal sectional view of the preferred embodiment of the invention in its starting position.
Figure 2:
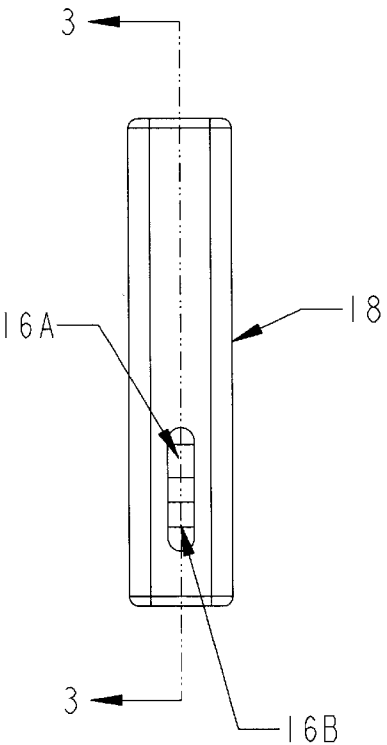
FIG. 2 is side elevation of the preferred embodiment of the invention in its starting position.
Figure 5:
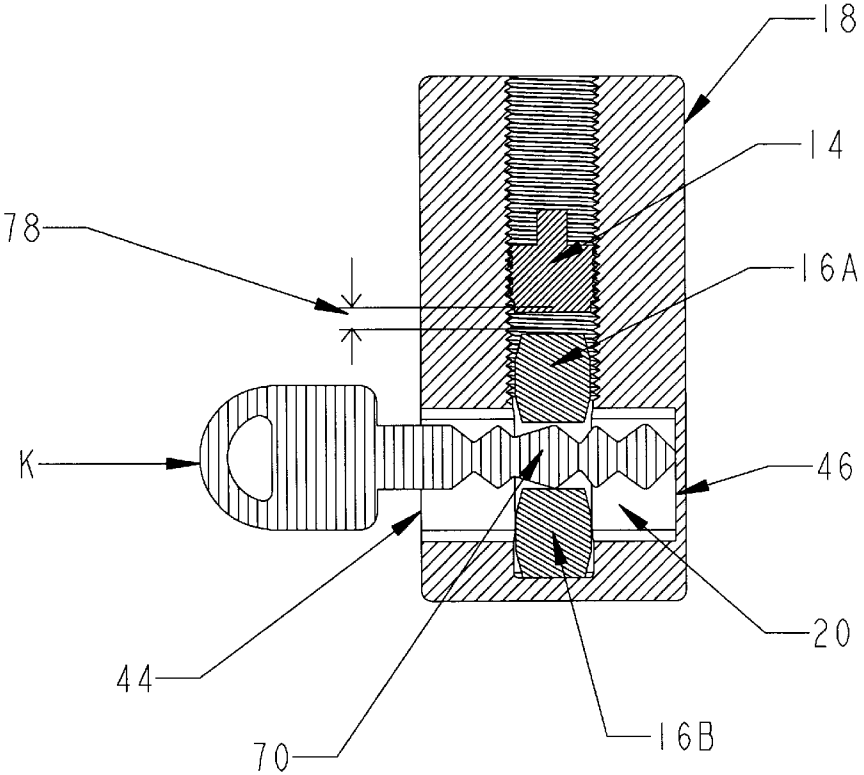
FIG. 5 is a longitudinal sectional view of the preferred embodiment of the invention prior to clamping.
Figure 6:
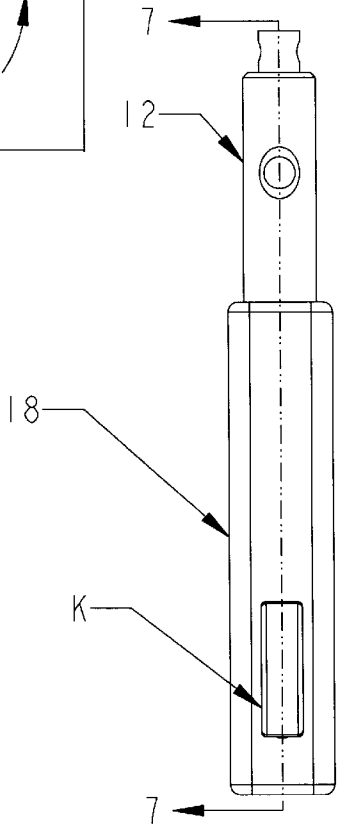
FIG. 6 is side elevation of the preferred embodiment of the invention in its clamped position.

FIG. 2 and FIG. 3 show the invention 10 in its starting position. The deformable substrates 16*a* and 16*b* move freely within the bore 22 and due to gravity are resting at the closed end 40 of said bore. In its starting position, the locking screw 14 is positioned far enough away from the top deformable substrate 16*a* such that there is a sufficient distance 80 between them to allow the introduction of the key K without immediately jamming the top substrate 16*a* into the locking screw 14. Consequently, the key K may be freely introduced into the invention 10. As seen in FIG. 5, after the key K is introduced into the invention 10, the space between the locking screw 14 and the top substrate 16*a* is reduced to the distance 78.

Figure 7:
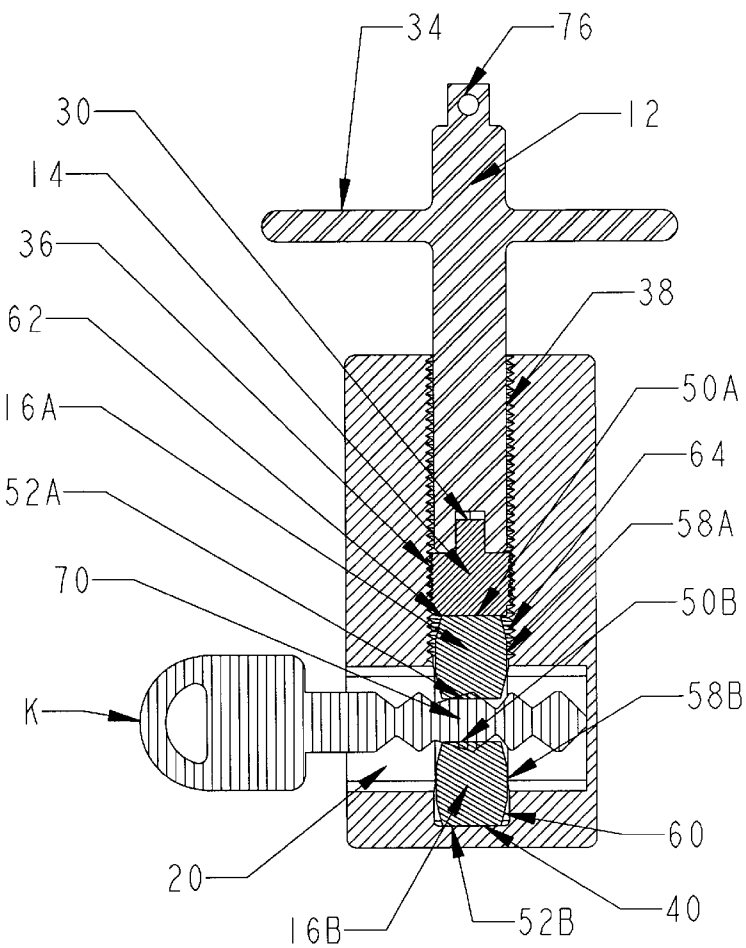
FIG. 7 is a longitudinal sectional view of the preferred embodiment of the invention in its clamped position.
Figure 8:
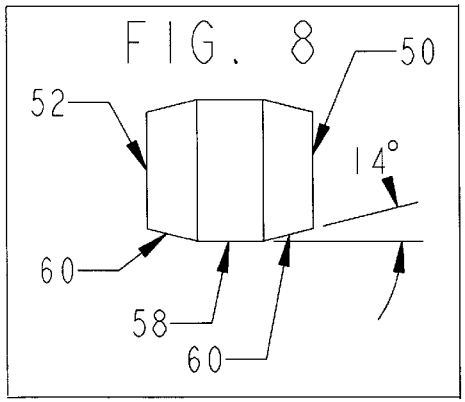
FIG. 8 is a side elevation of the deformable substrate.

FIG. 7 shows the invention 10 in its clamped position. In accordance with the operation directions above, the locking screw 14 has been turn downed axially into its locked position thereby squeezing the deformable substrates 16*a* and 16*b* between said screw and the closed end 40 of the bore 22. Consequently, the pressure caused by the downward axial movement of the locking screw 14 causes the deformable substrates 16*a* and 16*b* to deform around the working section 70 of key K thereby locking the same in position. At this point the key K can not be removed from the invention 10 without being damaged. The unique design of the deformable substrates 16*a* and 16*b* allows them to deform around and lock the key K without damaging the same.

When the invention in its locked position, the working section 70 of the key K is clamped between and touches the bottom surface 52a of the top deformable substrate 16*a* and the top surface 50b of the bottom deformable substrate 16*b*.

What is claimed is:

1. A portable non damaging key lock comprising:

a housing;

a bore;

a slot;

a locking screw;

a wrench;

deformable substrates;

where the bore is contained within and runs along the longitudinal axis of the housing;

where the housing comprises a longitudinal axis;

where the bore comprises a longitudinal axis an open end and a closed end, where the closed end acts as a positive stop for the deformable substrates;

where the locking screw is contained within the bore and is in operative relationship with the bore to move axially within the bore, where said movement towards the closed end of the bore provides a clamping means for the deformable substrates;

where the wrench extends within the bore to provide a means for the axial movement of the locking screw within the bore;

where the slot runs through and is transverse to the longitudinal axis of the bore, where the slot provides a means for the introduction of the working section of a key in parallel with the bore;

where the slot has an open end and a closed end, where the closed end provides a positive stop for the key;

where the deformable substrates move axially and freely within the bore;

where the deformable substrates surround the working section of the key upon the introduction of the key into slot; and where upon clamping the deformable substrates provide a means for immobilizing the key while not damaging the same.

2. A non damaging key lock as in claim 1 wherein the deformable substrates are made of acetal copolymer.

* * * * *